US008408193B2

(12) United States Patent
McPherson

(10) Patent No.: US 8,408,193 B2
(45) Date of Patent: Apr. 2, 2013

(54) ARCHERY BOW AXLE CONNECTOR

(75) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 321 days.

(21) Appl. No.: 12/794,526

(22) Filed: Jun. 4, 2010

(65) Prior Publication Data

US 2010/0307471 A1 Dec. 9, 2010

Related U.S. Application Data

(60) Provisional application No. 61/184,623, filed on Jun. 5, 2009.

(51) Int. Cl.
*F41B 5/10* (2006.01)

(52) U.S. Cl. ..... 124/25.6

(58) Field of Classification Search ..... 124/25.6, 124/900

See application file for complete search history.

(56) References Cited

U.S. PATENT DOCUMENTS

| | | | | |
|---|---|---|---|---|
| D42,639 | S | 6/1912 | Marshall | |
| 4,258,464 | A | 3/1981 | Ullman, Jr. | |
| 4,546,754 | A * | 10/1985 | Smith | 124/86 |
| 4,605,335 | A | 8/1986 | Otrusina | |
| 4,781,167 | A * | 11/1988 | Martin | 124/25.6 |
| 4,926,833 | A | 5/1990 | Darlington | |
| 4,967,721 | A | 11/1990 | Larson | |
| 5,146,908 | A | 9/1992 | Larson | |
| 5,362,282 | A | 11/1994 | Lickton | |
| 5,606,963 | A * | 3/1997 | Wenzel et al. | 124/86 |
| D386,141 | S | 11/1997 | Pingel et al. | |
| 5,697,355 | A | 12/1997 | Schaffer | |
| 6,035,840 | A | 3/2000 | McPherson | |
| 6,360,735 | B1 | 3/2002 | Larson et al. | |
| 6,443,139 | B1 | 9/2002 | McPherson | |
| 6,474,324 | B1 | 11/2002 | Despart et al. | |
| 6,966,312 | B1 | 11/2005 | Larson | |
| 8,037,876 | B1 | 10/2011 | Yehle | |
| 8,056,548 | B1 | 11/2011 | Larson | |
| 8,069,848 | B1 | 12/2011 | Larson | |
| 2008/0127956 | A1 | 6/2008 | Bednar et al. | |
| 2010/0154769 | A1 | 6/2010 | Grace, Jr. | |
| 2010/0263650 | A1 | 10/2010 | Dahl et al. | |

OTHER PUBLICATIONS

U.S. Appl. No. 61/184,623, filed Jun. 5, 2009; Inventor: Mcpherson.

* cited by examiner

*Primary Examiner* — John Ricci
(74) *Attorney, Agent, or Firm* — Vidas, Arrett & Steinkraus

(57) ABSTRACT

In some embodiments, a connector attaches to an axle of an archery bow and comprises a cable terminal. The connector comprises a body having a groove extending around at least a portion of its periphery. The groove defines a longitudinal axis, and the longitudinal axis forms a teardrop shape. In some embodiments, the connector is configured to snap-fit onto an axle and be removable without tools.

20 Claims, 5 Drawing Sheets

ARCHERY BOW AXLE CONNECTOR

BACKGROUND OF THE INVENTION

This invention relates generally to archery bows and more specifically to an axle connector for use with archery bows.

Archery bows having "split limbs" are generally known in the art. Such bows typically include an axle extending between two split-limb portions. The axle can support a cam, pulley, etc. Clips attached to the ends of the axle secure the axle in place with respect to the limb.

Prior art axle clips generally require tools for installation or removal. For example, a spring tension clip having an E-configuration can engage the axle. So called E-clips generally require a tool for installation and removal, such as pliers. Some alternative axle clips are capable of being installed without tools, but require a tool such as a flathead screwdriver for removal.

There remains a need for archery bow axle connectors that are capable of quick installation and removal, without the need for tools.

U.S. Pat. Nos. 6,443,139 and 6,035,840 are hereby incorporated herein in their entireties. All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises an axle installed on a limb of the archery bow and a connector attached to the axle. The connector comprises a body having a groove extending around at least a portion of its periphery. The groove comprises a first straight portion, an arcuate portion and a second straight portion as it is traversed. The first straight portion is non-parallel to the second straight portion, for example forming a taper. A cable is positioned in the groove, such as a power cable of a compound archery bow.

In some embodiments, an archery bow comprises an axle installed on a limb of the archery bow and a connector attached to the axle. The connector comprises a body having a groove extending around at least a portion of its periphery. The groove defines a longitudinal axis. The longitudinal axis forms a teardrop shape. A cable is positioned in the groove.

In some embodiments, a cable connector is suitable for use on an axle of an archery bow. The cable connector comprises a body having a groove extending around at least a portion of its periphery. The groove defines a longitudinal axis. The longitudinal axis forms a teardrop shape.

In some embodiments, the cable connector is configured to snap-fit onto an axle and be removable without tools.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 2:
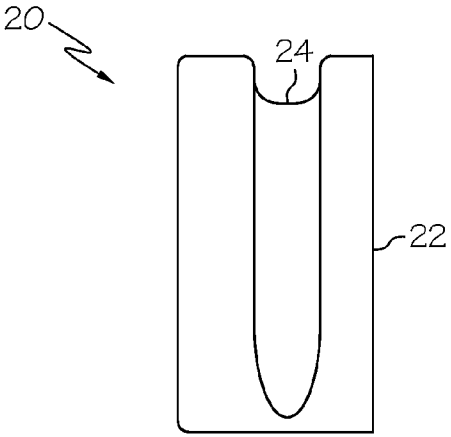
FIG. 2 shows a side view of an embodiment of an archery bow axle connector.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the Figures shall refer to like features unless otherwise indicated.

Figure 1:
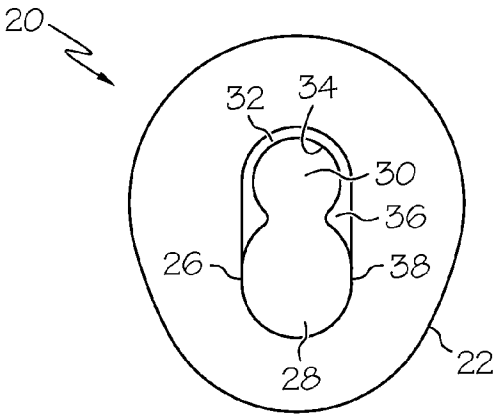
FIG. 1 shows a front view of an embodiment of an archery bow axle connector.
Figure 7:
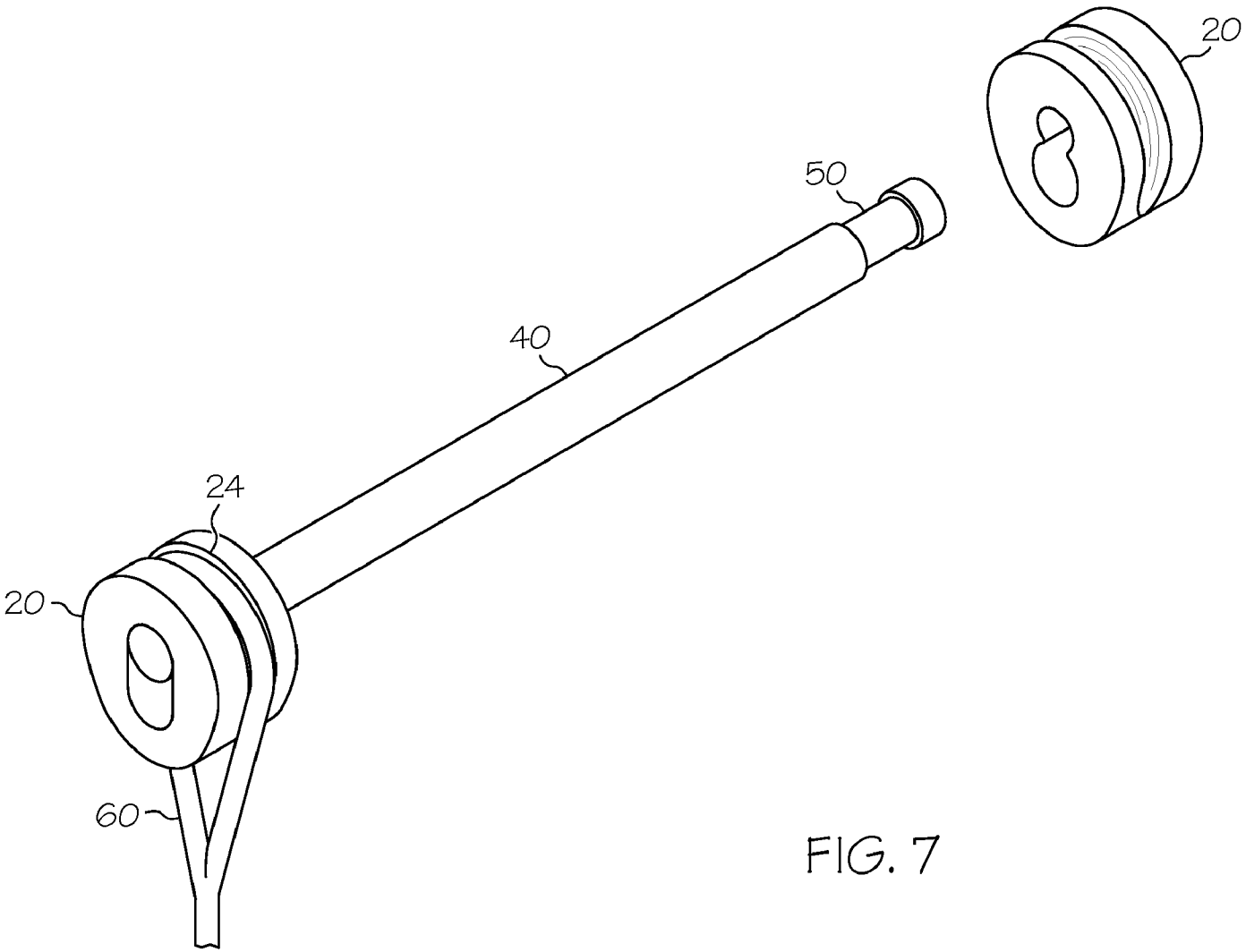
FIG. 7 shows examples of archery bow axle connectors and an archery bow axle.
Figure 8:
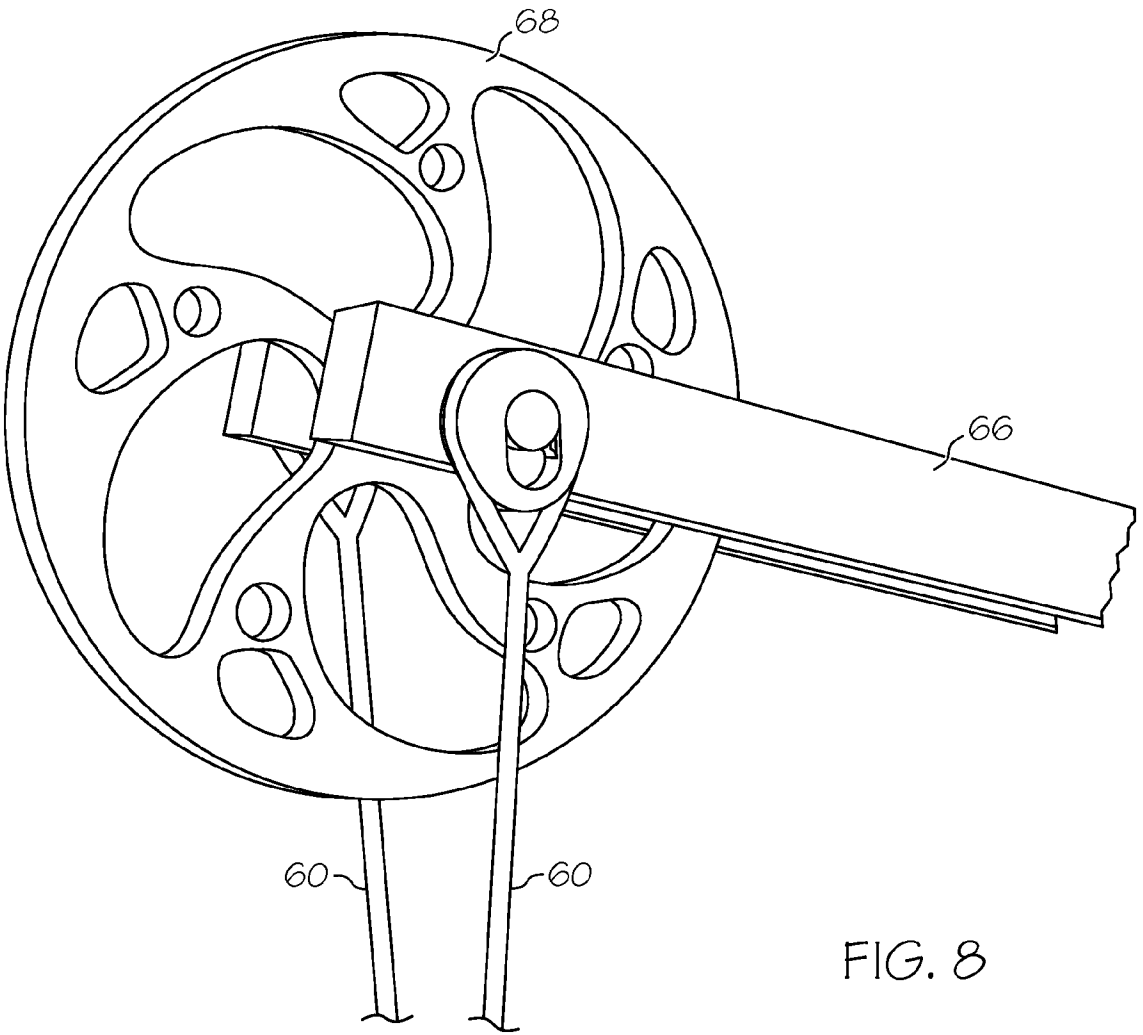
FIG. 8 shows an archery bow axle connector and an axle on a bow limb.

FIG. 1 shows an embodiment of an axle connector 20. An axle connector 20 can be used in an archery bow in conjunction with an axle 40, for example as shown in FIGS. 7 and 8. The axle connector 20 can also be considered a cable connector and/or a cable terminal.

Figure 3:
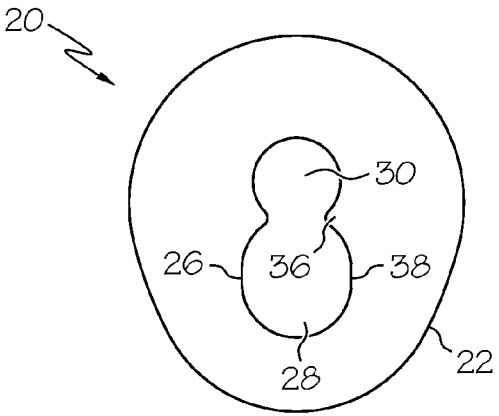
FIG. 3 shows a back view of an embodiment of an archery bow axle connector.

FIG. 2 shows a side view of an embodiment of an axle connector 20, and FIG. 3 shows a back view.

Referring to FIGS. 1-3, in some embodiments, an axle connector 20 comprises a shaped body 22. The body 22 comprises an aperture 26 that is suitably shaped to engage an axle 40 (see FIG. 7). An aperture 26 can pass through the body 22 completely. In some other embodiments, a cavity can be provided in the body 22 which does not extend through the body 22 completely.

In some embodiments, the aperture 26 or cavity comprises a first portion 28 and a second portion 30. The first portion 28 is typically larger than the second portion 30, and the second portion 30 is configured to engage an axle 40. For example, the second portion 30 can be sized to engage a suitable axle with a snap fit. In some embodiments, the second portion 30 and axle are sized to achieve an interference fit. In some embodiments, an axle 40 can fit easily into the first portion 28, for example having a smaller size than the first portion 28, and the axle 40 can be snapped into the second portion 30. Thus, the axle 40 and connector 20 are moveable with respect to one another between attached configuration and detached configurations. The axle 40 is positioned in the second portion 30 of the aperture 26 in the attached configuration.

In some embodiments, a sidewall 38 of the aperture 26 comprises a raised flange 32. At least a portion of the second portion 30 is defined by the raised flange 32. The raised flange 32 comprises an engaging surface 34 for engaging an axle. In some embodiments, the engaging surface 34 is semicircular.

In some embodiments, the engaging surface 34 contacts an axle 40 and forms an arc of contact. The arc of contact defines a central angle θ (see FIG. 4), and the central angle θ is desirably greater than 180 degrees. In some embodiments, the central angle θ can range from over 180 degrees to 300 or more degrees. In some embodiments, the central angle θ is approximately 220 degrees.

In some embodiments, the raised flange 32 comprises one or more peaks 36, which help to achieve a reliable snap fit between the axle connector 20 and the axle 40. In some embodiments, the two peaks 36 are separated by a distance, and the distance is smaller than a diameter/size of the axle 40 that passes through the peaks 36 and is engaged by the flange 32.

In some embodiments, the first portion 28 and second portion 30 collectively form a figure-eight shape. In some embodiments, a distance across the first portion 28 is greater than a distance across the second portion 30.

In some embodiments, an axle connector 20 comprises a groove 24 that extends around at least a portion of its periphery. A groove 24 can be used, for example, to anchor an archery bow cable to the axle connector 20.

Figure 5:
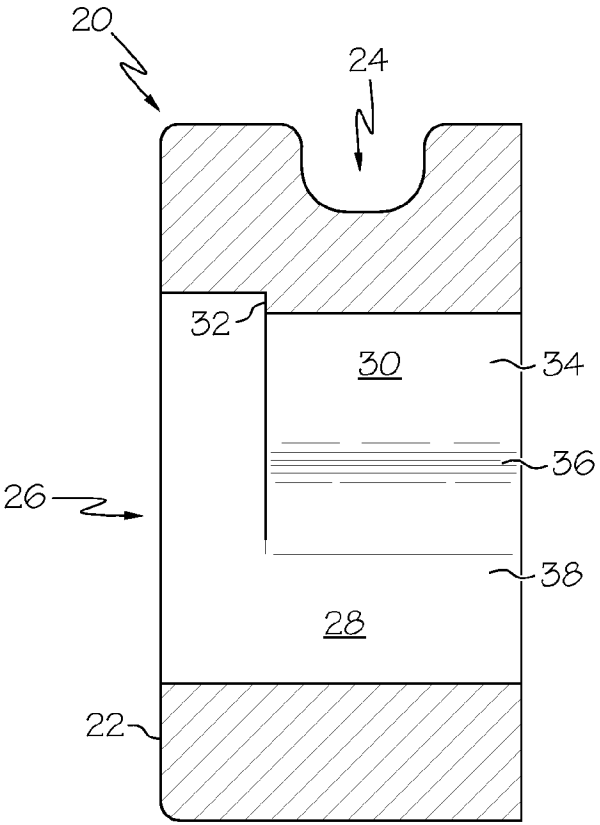
FIG. 5 shows a cross-sectional view of an embodiment of an archery bow taken across line 5-5 in FIG. 4.
Figure 4:
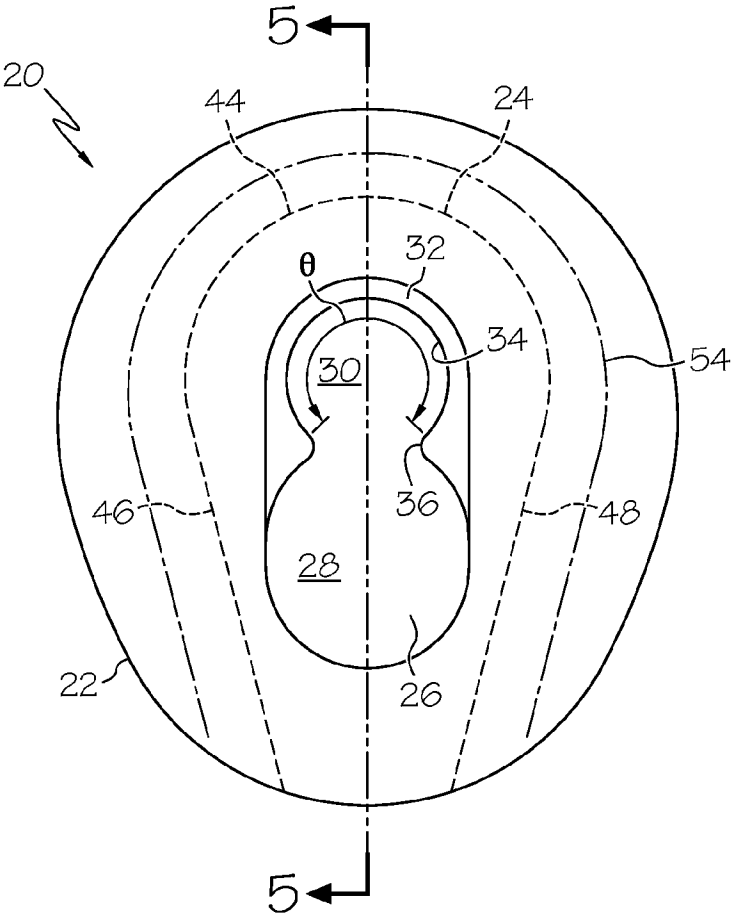
FIG. 4 shows another front view of an embodiment of an archery bow axle connector.

FIG. 4 shows another front view of an embodiment of an axle connector 20, and FIG. 5 shows a cross-sectional view taken across line 5-5 in FIG. 4. The contour of an embodiment of a groove 24 is shown in FIG. 4.

In some embodiments, a groove 24 defines a teardrop shape. For example, the groove 24 defines a longitudinal axis 54 that extends around the axle 40. The longitudinal axis 54 of the groove 24 defines a substantially teardrop shape. In some embodiments, a groove 24 comprises a first straight portion 46, an arcuate portion 44 and a second straight portion 48 as the groove 24 is traversed along its length. The first straight portion 46 is nonparallel to the second straight portion 48, for example forming a taper that extends away from the arcuate portion 44. An end of each straight portion 46, 48 abut the respective ends of the arcuate portion 44.

In some embodiments, a depth of the groove 24 decreases along the length of a straight portion 46, 48 as the straight portion is traversed in a direction away from the arcuate portion 44.

In some embodiments, an arcuate portion 44 of the groove 24 is concentric with the second portion 30 of the aperture 26 in the body 22, and/or concentric with at least a portion of the engaging surface 34.

In some embodiments, the second portion 30 of the aperture 26 is located closer to the arcuate portion 44 of the groove 24 that to the first portion 28 of the aperture 26. Thus, when the axle connector 20 is being mounted on an axle, the axle is first oriented in the first portion 28. Forces are applied to the axle connector 20 and the axle in opposite direction, snapping the axle into the second portion 30 of the aperture 26. When the second portion 30 of the aperture 26 is located closer to the arcuate portion 44 of the groove 24, forces applied to the axle connector 20 by a cable oriented within the groove 24 will work to retain the axle in the second portion 30 of the aperture 26. Thus, in some embodiments, a cable applies forces to the axle connector 20 in the same direction necessary to install the axle connector 20 on the axle, and in the opposite direction as would be necessary to remove the axle connector 20 from the axle. The teardrop shape insures that once a cable is attached, any pressure applied by the cable maintains alignment of the axle connector 20 with the cable yoke, and retains the axle connector 20 in the installed configuration until the cable forces are removed. The teardrop shape also conforms to the natural shape of a loop formed in the cable to anchor the cable to the axle connector 20 (see FIGS. 7 and 8).

As shown in FIG. 5, in some embodiments, the depth of the raised flange portion 32 and a depth of the engaging surface 34 is less than the total depth of the axle connector 20.

Figure 6:
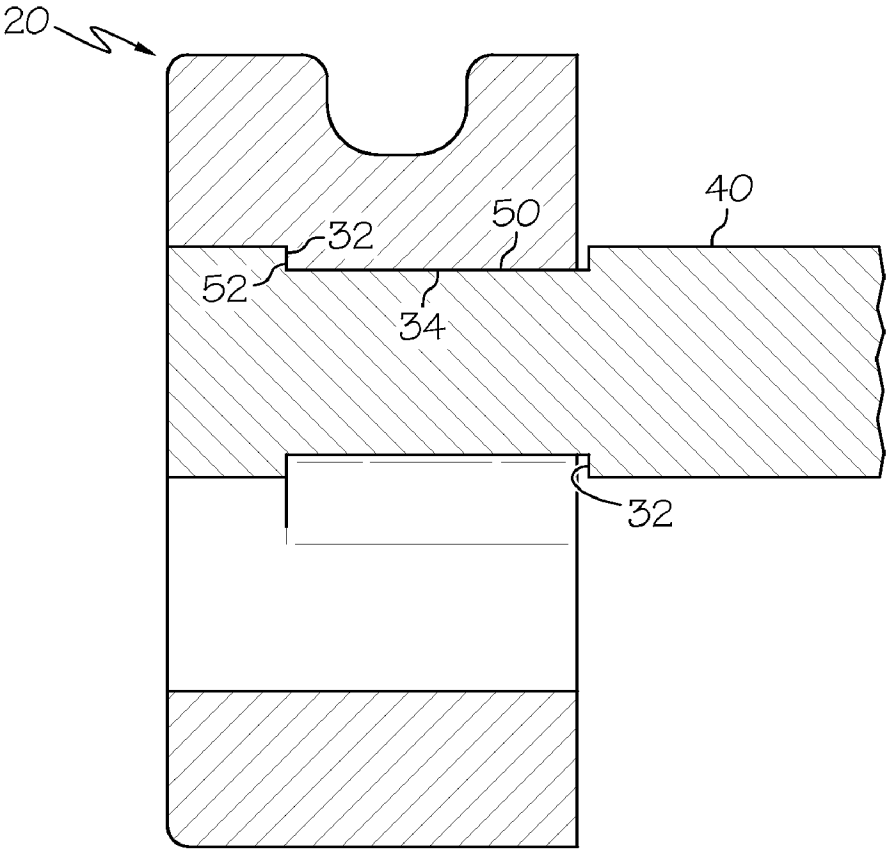
FIG. 6 shows a cross-sectional view similar to that of FIG. 5, also showing an embodiment of an archery bow axle.

FIG. 6 shows a cross-sectional view similar to that of FIG. 5, which also shows an embodiment of an archery bow axle 40 configured for attachment to the axle connector 20. In some embodiments, an axle 40 comprises an engagement region 50. In some embodiments, the engagement region 50 is configured for an interference fit with a portion of the axle connector 20. For example, an outer surface of the engagement region 50 and the inner/engaging surface 34 of the aperture 26 are sized to achieve an interference fit.

In some embodiments, the engagement region 50 comprises a groove or recess in the axle 40. The size of the axle 40 at such a recess defines a recessed size or a recessed diameter compared to larger portions of the axle 40. In some embodiments, at least a portion of the raised flange 32 of the connector 20 becomes positioned in the recess 50 of the axle 40.

In some embodiments, a length of the engagement region 50 is similar to a depth of the raised flange portion 32 and/or engagement region 34 of the axle connector 20. Desirably, the length of the engagement region 50 and the depth of the raised flange 32 are measured in the same direction (e.g. parallel). In some embodiments, the groove creates raised flanges 52 in the axle 40, and a flange 52 can abut the raised flange 32 of the axle connector 20.

The engagement between the axle 40 and the axle connector 20 desirably prevents movement of the axle connector 20 along the length of the axle 40. The engagement between the axle 40 and the axle connector 20 desirably allows rotation of the axle connector 20 about the axle 40.

FIG. 7 shows an embodiment of an axle 40 and two examples of an axle connector 20. A cable 60 is shown oriented in the groove 24 of one axle connector 20. The teardrop shape of the groove 24 matches the teardrop shape formed by the cable 60.

FIG. 8 shows an embodiment of an axle 40 and axle connectors 20 installed on an archery bow limb 66. The axle 40 supports a rotatable member 68, such as a cam or pulley. The axle connectors 20 engage the axle 40 and prevent the axle 40 from displacing along its longitudinal axis. The cables 60 comprise a split yoke forming a first portion and a second portion, the first portion terminates on the first connector and the second portion terminates on the second connector.

The axle connectors 20 allow assembly of the components illustrated in FIG. 8 without the use of tools. Further, the axle connectors 20 can be snapped off of the axle 40 upon the application of force in the correct direction without the use of tools, so the components can be disassembled without tools.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

an axle installed on a limb of the archery bow;

a connector attached to the axle, the connector comprising a body having a groove extending around at least a portion of its periphery, the groove comprising a first straight portion, an arcuate portion and a second straight portion as it is traversed, the first straight portion being non-parallel to the second straight portion; and a cable positioned in the groove;

wherein the connector comprises an aperture therein, the axle extends through the aperture, the aperture configured to achieve a snap fit with the axle.

2. The archery bow of claim 1, wherein the first straight portion comprises a first end and a second end, the second straight portion comprises a first end and a second end, the first end of the first straight portion and the first end of the second straight portion abut ends of the arcuate portion; and the first end of the first straight portion and the first end of the second straight portion separated by a first distance, the second end of the first straight portion and the second end of the second straight portion separated by a second distance, wherein the first distance is longer than the second distance.

3. The archery bow of claim 1, wherein the connector is fixed from moving along a length of the axle when attached to the axle.

4. The archery bow of claim 1, wherein the groove defines a longitudinal axis, the longitudinal axis forming a teardrop shape.

5. The archery bow of claim 1, the aperture having a first portion and a second portion, the first portion being larger than the second portion.

6. The archery bow of claim 5, the axle having an outer diameter, wherein the first portion of the aperture is larger than the outer diameter.

7. The archery bow of claim 6, wherein the second portion of the aperture is smaller than the outer diameter.

8. The archery bow of claim 6, wherein the axle comprises a recessed portion having an outer surface, the outer surface contacting an inner surface of said second portion, an arc of contact between the outer surface and the inner surface defining a central angle, the central angle being greater than 180 degrees.

9. The archery bow of claim 8, wherein the outer surface and inner surface are sized to achieve an interference fit.

10. The archery bow of claim 5, wherein the axle and the connector are moveable with respect to one another between an attached configuration and a detached configuration, the axle positioned in the second portion of the aperture in the attached configuration.

11. The archery bow of claim 5, wherein the second portion of the aperture is defined by a raised flange.

12. The archery bow of claim 11, wherein the axle further comprises a recess, the raised flange extending into said recess.

13. The archery bow of claim 12, wherein recess has a length, the flange has a depth, said length and said depth measured in the same direction, the length of the recess being approximately equal to the depth of the flange.

14. The archery bow of claim 11, wherein the axle further comprises a recess having a recessed diameter, the flange comprises two peaks, the two peaks are separated by a distance, and the distance is smaller than the recessed diameter.

15. The archery bow of claim 5, wherein the first portion and the second portion collectively form a figure-eight shape.

16. The archery bow of claim 1, wherein said connector comprises a first connector, the archery bow further comprises a second connector attached to the axle, the cable comprises a split yoke comprising a first portion and a second portion, the first portion terminates on the first connector and the second portion terminates on the second connector.

17. An archery bow comprising:

an axle installed on a limb of the archery bow;

a connector attached to the axle, the connector comprising a body having a groove extending around at least a portion of its periphery, the groove comprising a first straight portion, an arcuate portion and a second straight portion as it is traversed, the first straight portion being non-parallel to the second straight portion, the first straight portion comprising a first end and a second end, the second straight portion comprising a first end and a second end, the first end of the first straight portion and the first end of the second straight portion abuting ends of the arcuate portion, the first end of the first straight portion and the first end of the second straight portion separated by a first distance, the second end of the first straight portion and the second end of the second straight portion separated by a second distance, wherein the first distance is longer than the second distance; and a cable positioned in the groove;

wherein the groove has a depth, the depth decreasing from the first end of the first straight portion to the second end of the first straight portion, the depth decreasing from the first end of the second straight portion to the second end of the second straight portion.

18. An archery bow comprising:

an axle installed on a limb of the archery bow;

a connector attached to the axle, the connector comprising a body having a groove extending around at least a portion of its periphery, the groove defining a longitudinal axis, the longitudinal axis forming a teardrop shape, the groove having a varying depth; and a cable positioned in the groove.

19. A cable connector for use on an axle of an archery bow, the cable connector comprising:

a body having a groove extending around at least a portion of its periphery, the groove defining a longitudinal axis, the longitudinal axis forming a teardrop shape, the groove having a varying depth.

20. A cable connector for use on an axle of an archery bow, the cable connector comprising:

a body having a groove extending around at least a portion of its periphery, the groove defining a longitudinal axis, the longitudinal axis forming a teardrop shape;

wherein the body comprises an aperture defining a figure-eight shape having first and second portions, the second portion smaller than the first portion, the second portion configured to engage said axle.

* * * * *